US012680441B2

(12) United States Patent
Fox et al.

(10) Patent No.: US 12,680,441 B2
(45) Date of Patent: Jul. 14, 2026

(54) SPIRAL WAVEFORM ANALYSIS FOR BEHIND PIPE CEMENT EVALUATION, WELL ABANDONMENT OPERATIONS AND COMPLEX ANNULAR ENVIRONMENTS

(71) Applicant: Halliburton Energy Services, Inc., Houston, TX (US)

(72) Inventors: Philip Edmund Fox, New Orleans, LA (US); Gary James Frisch, Houston, TX (US); Rachel Marie Confer, Houston, TX (US); Michael J. Englar, New Orleans, LA (US)

(73) Assignee: Halliburton Energy Services, Inc., Houston, TX (US)

( * ) Notice: Subject to any disclaimer, the term of this patent is extended or adjusted under 35 U.S.C. 154(b) by 134 days.

(21) Appl. No.: 18/656,009

(22) Filed: May 6, 2024

(65) Prior Publication Data

US 2025/0341161 A1 Nov. 6, 2025

(51) Int. Cl.
*E21B 47/005* (2012.01)
*E21B 47/16* (2006.01)

(52) U.S. Cl.
CPC ..... *E21B 47/005* (2020.05); *E21B 47/16* (2013.01)

(58) Field of Classification Search
CPC ..... E21B 47/005; E21B 47/16
See application file for complete search history.

(56) References Cited

U.S. PATENT DOCUMENTS

| | | | | |
|---|---|---|---|---|
| 9,519,865 | B2 | 12/2016 | Quirein et al. | |
| 9,822,629 | B2 | 11/2017 | Suparman et al. | |
| 10,180,511 | B2 | 1/2019 | Frisch | |
| 10,221,673 | B2 | 3/2019 | Frisch et al. | |
| 10,408,037 | B2 | 9/2019 | Frisch et al. | |
| 10,527,752 | B2 * | 1/2020 | Fox | E21B 47/005 |
| 10,731,455 | B2 * | 8/2020 | Fox | G01V 1/40 |
| 2009/0168597 | A1 | 7/2009 | Wu et al. | |
| 2011/0080805 | A1 * | 4/2011 | Vu | G01V 1/46 367/32 |
| 2013/0081804 | A1 | 4/2013 | Sinha et al. | |
| 2014/0114892 | A1 | 4/2014 | Quirein et al. | |

(Continued)

FOREIGN PATENT DOCUMENTS

| | | | | |
|---|---|---|---|---|
| CA | 3088619 A1 * | 8/2019 | | G01V 11/005 |
| CN | 115077683 A * | 9/2022 | | G01H 9/004 |

(Continued)

OTHER PUBLICATIONS

Translation of CN115077683 (Year: 2022).*

(Continued)

*Primary Examiner* — Daniel Pihulic
(74) *Attorney, Agent, or Firm* — John Wustenberg; C. Tumey Law Group PLLC—HES

(57) ABSTRACT

In general, in one aspect, embodiments relate to a method and/or system that includes disposing a cement bond logging tool into a wellbore. The method and/or system comprising: a cement bond logging tool comprising: two or more transmitters configured to transmit an acoustic wave from cement bond logging tool; and an array of receivers configured to receive a refracted waveform; and an information handling system configured to process the refracted waveform from the array of receivers into a cement bond property log.

20 Claims, 8 Drawing Sheets

(56) References Cited

U.S. PATENT DOCUMENTS

| | | | | |
|---|---|---|---|---|
| 2016/0194947 | A1 | 7/2016 | Suparman et al. | |
| 2016/0202387 | A1* | 7/2016 | Fox | E21B 47/00 73/152.58 |
| 2017/0248003 | A1 | 8/2017 | Frisch et al. | |
| 2019/0153858 | A1 | 5/2019 | Kinn et al. | |
| 2021/0396126 | A1* | 12/2021 | Wang | E21B 47/0228 |
| 2024/0288600 | A1 | 8/2024 | Chang et al. | |
| 2025/0341161 | A1* | 11/2025 | Fox | E21B 47/005 |

FOREIGN PATENT DOCUMENTS

| | | | | |
|---|---|---|---|---|
| EP | 1275983 | A2 * | 1/2003 | G01V 1/44 |
| JP | 4774184 | B2 * | 9/2011 | G01V 1/226 |
| WO | WO-2016040062 | A1 * | 3/2016 | E21B 47/005 |
| WO | WO-2018125114 | A1 * | 7/2018 | G01V 5/107 |
| WO | WO-2019147139 | A2 * | 8/2019 | E21B 47/107 |
| WO | WO-2023075870 | A1 * | 5/2023 | G01V 1/523 |

OTHER PUBLICATIONS

Donovan, G., Fadesere, P., Ware, G., Daigle, L., Suparman, F., Frisch, G., . . . Guo, W. (2015). Behind Pipe Log Evaluation Study: Deepwater Subsea Abandonments in the Gulf of Mexico. SPE Annual Technical Conference and Exhibition.

Frisch, G., Fox, P., Hospedales, D., & Lutchman, K. (2015). Using Radial Bond Segmented Waveforms to Evaluate Cement Sheath at Varying Depths of Investigation. SPE Annual Technical Conference and Exhibition.

PCT Application No. PCT/US2015/44508 filed Aug. 10, 2015.

U.S. Appl. No. 14/895,039, filed Dec. 1, 2015.

PCT Application No. PCT/US2015/48016 filed Sep. 2, 2015.

U.S. Appl. No. 14/900,739, filed Dec. 22, 2015.

PCT Application No. PCT/US2016/019761 filed Feb. 26, 2016.

U.S. Appl. No. 15/768,512, filed Apr. 13, 2018.

International Search Report and Written Opinion for International Patent Application No. PCT/US2024/032282 dated Jan. 20, 2025. PDF file. 8 pages.

* cited by examiner

SPIRAL WAVEFORM ANALYSIS FOR BEHIND PIPE CEMENT EVALUATION, WELL ABANDONMENT OPERATIONS AND COMPLEX ANNULAR ENVIRONMENTS

BACKGROUND

In the oil and gas industry, after drilling a wellbore it is common practice to line the wellbore with one or more strings of pipe known in the industry as "casing," and secure the casing in the wellbore with cement pumped into the annulus defined between the casing and the wall of the wellbore. In some cases, two or more strings of casing are concentrically positioned in the wellbore and cement is pumped in between the casings and the wellbore annulus to secure the casings within the wellbore.

Good cement bonding characterization between the casing and the wellbore, and also the location and distribution of other classes of materials and their characterization, is essential and particularly critical in the case of plug and abandonment operations. For instance, accurately characterizing the materials or substances disposed within the annulus, and determining their azimuthal and depth distributions throughout the wellbore may help an operator determine a preferred location to cut the casing so that upper portions of the casing may be pulled out of the wellbore. More particularly, determining the azimuthal and depth location of particular materials present within the annulus may help determine where the casing is relatively "free," or has little resistance to being extracted (pulled) from the well after it is excised from lower. It is also desirable to estimate the forces required to extract cut casing when portions of the casing are covered entirely or in part by solids and/or gelled materials that increase the friction existing between the casing and materials in the annulus.

Past methods to accomplish this include using data acquired from cement bond logging tools, such as omnidirectional or sectored/segmented logging tools, and ultrasonic measurement tools. Cement bond logging tools and ultrasonic measurement tools, however, are unable to make accurate determinations of the presence of certain substances in the wellbore annulus, such as settled drilling fluid ("mud") solids. Over a period of years from the initial completion of the well to the time of well abandonment, drilling fluids left in place in the wellbore annulus deteriorate and precipitate the suspended weighting materials, which often accumulate between concentric or overlapping layers of casing. These solids can act as a binding agent that makes it harder to extract cut casing above a cutting depth.

By relying only on acoustic measurements, the identification of such solids is often inaccurate, if not impossible. This is because acoustic sensor readings for such solids fail to provide significant contrast to adjacent materials present in the wellbore annulus at a suitable level sufficient for identification purposes. This often results in the incorrect determination of the character of materials within the annulus and, therefore, a resulting miscalculation of optimal or feasible cutting forces required to extract the casing.

Previously, to get around extracting the casing methods were developed to segmented measurements directed along the borehole axis measured in multiple directions circumferentially around the borehole. These usually provided 6 or 8 planes through the well and cement mappings were presented to indicate cement bond quality and distribution. Features of the annular region of interest include well cemented intervals (isolated), partially bonded either from slurry contamination or channeled effects and top of cement trending into liquids (drilling mud typically) above the top of cement.

BRIEF DESCRIPTION OF THE DRAWINGS

These drawings illustrate certain aspects of some examples of the present disclosure and should not be used to limit or define the disclosure.

DETAILED DESCRIPTION

This disclosure may generally relate to systems and methods for advanced acoustic evaluation. Advanced acoustic evaluation is provided from the Advanced Cement Evaluation (ACE) and Peak Analysis for Cement Evaluation (PACE) and PACERS for segmented radial bond tools. Specifically, systems and methods include axially aligned transmitter to receiver acoustic energy characterization and expand to include spiral sampling of waveform acoustic energy analysis. New systems and methods evaluate comparison of the nearest baseline chosen reference hydrophone receiver station to the next further away receiver station. In addition, the receivers are evaluated for comparison between offset receivers in the next array moving spirally in 45-degree increments. As described below, sampling and evaluation may be implemented at selectable receiver station levels spaced as desired through the hydrophone receiver array. Methods and systems herein apply enhanced evaluation of annular volume contents outside a first pipe surrounding the logging device. Additionally, evaluation of larger concentric pipes surrounding the primary innermost pipe can be achieved. This provides analysis of annular contents in multiple pipe strings within the wellbore. The new method provides details of circumferential distribution of materials in the surveyed interval.

Figure 1:
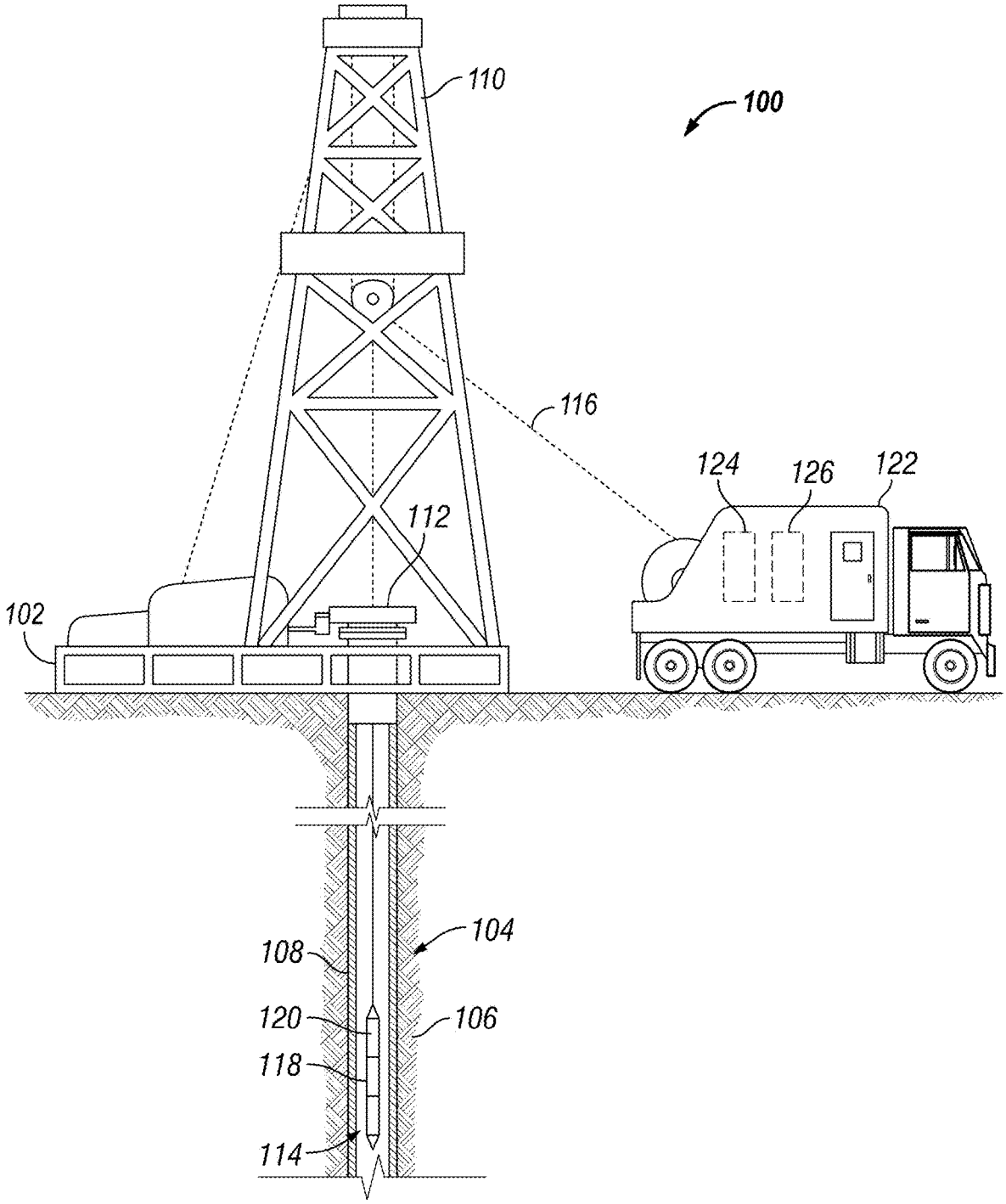
FIG. 1 illustrates a schematic diagram of an exemplary wellbore logging system.

FIG. 1 illustrates a schematic diagram of an exemplary wellbore logging system 100 that may employ the principles of the present disclosure, according to one or more embodiments. As illustrated, wellbore logging system 100 may include a surface platform 102 positioned at the earth's surface and a wellbore 104 that extends from the surface platform 102 into one or more subterranean formations 106. In other embodiments, such as in offshore operations, a volume of water may separate the surface platform 102 and the wellbore 104. Wellbore 104 may be lined with one or more strings of casing 108 and secured in place with cement. In some embodiments, portions of the wellbore 104 may have only one casing 108 secured therein, but other portions of the wellbore 104 may be lined with two or more strings of casing 108 that overlap each other or are concentrically positioned. The casings 108 may be made of plain carbon steel, stainless steel, or another material capable of withstanding a variety of forces, such as collapse, burst, and tensile failure.

The wellbore logging system 100 may include a derrick 110 supported by the surface platform 102 and a wellhead installation 112 positioned at the top of the wellbore 104. A tool string 114, which may alternatively be referred to as a "sonde," may be suspended into the wellbore 104 on a cable 116. The tool string 114 may include multiple sensors or logging tools 118 used to analyze the bond integrity between the casing 108 and the cement or other material that bonds the casing 108 to the wellbore 104. More particularly, the logging tools 118 may be configured to detect the presence of a gas, a liquid, a settled mud solid (i.e. barite), cement, or any combination of the foregoing materials at any depth in the wellbore 104 at the interface between the casing 108 and the cement. Logging tools 118 may include, but are not limited to, a cement bond logging tool, a circumferential acoustic scanning tool, a spectral density logging tool, and a dual spaced neutron logging tool. Those skilled in the art will readily appreciate that the logging tools 118 may be expanded to include other known sensors, or those developed in the future with suitable application, without departing from the scope of the disclosure.

The tool string 114 may also include a communication module 120 having an uplink communication device, a downlink communication device, a data transmitter, and a data receiver. Conductors in cable 116 provide power to the logging tools 118 and communicably couple the logging tools 118 to a logging facility 122 situated at a surface location. In the illustrated embodiment, logging facility 122 is depicted as a truck, but could alternatively be another type of computing facility commonly used in the art. The logging facility 122 may include a surface communication module 124 and an information handling system 126. The surface communication module 124 may include an uplink communication device, a downlink communication device, a data transmitter, and a data receiver. The information handling system 126 may comprise any suitable type of processing logic and may include a logging display and one or more recording devices. The information handling system 126 comprises processing logic (e.g., one or more processors) and has access to software (e.g., stored on any suitable computer-readable medium housed within or coupled to information handling system 126) and/or input interfaces that enable the information handling system 126 to perform, assisted or unassisted, one or more of the methods and techniques described herein. In operation, the logging facility 122 may collect measurements from the logging tools 118 via the communication modules 120, 124, and the information handling system 126 may control, process, store, and/or visualize the measurements gathered by the logging tools 118.

In some embodiments, processing logic (e.g., one or more processors) and storage (e.g., any suitable computer-readable medium) may be disposed downhole within the tool string 114 and may be used either in lieu of the information handling system 126 or in addition thereto. In such embodiments, memory housed within the tool string 114 may store data (such as that obtained from the logging operations described herein), which may be downloaded and processed using the information handling system 126 or other suitable processing logic once the tool string 114 has been raised to the surface. In some embodiments, processing logic housed within the tool string 114 may process at least some of the data stored in the memory within the tool string 114 before the tool string 114 is raised to the surface.

Figure 2:
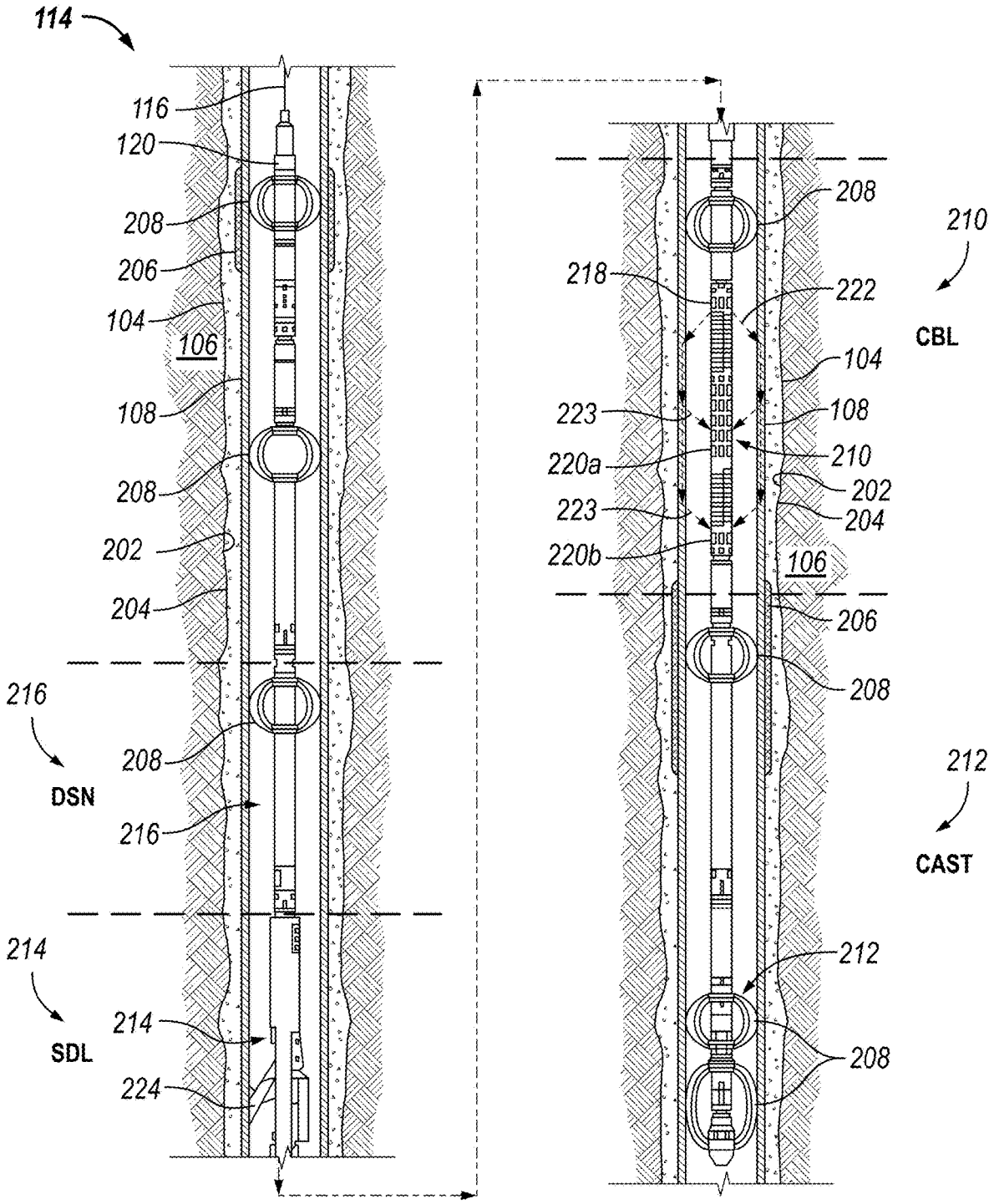
FIG. 2 illustrates an enlarged view of an exemplary embodiment of the tool string.

FIG. 2 illustrates an enlarged view of an exemplary embodiment of the tool string 114 of FIG. 1. As illustrated, the tool string 114 is conveyed on the cable 116 into the wellbore 104, which penetrates the surrounding subterranean formation 106 and is lined with the casing 108. An annulus 202 defined between the casing 108 and the wall of the wellbore 104 may be filled with cement 204 and/or other materials that secure or bond the casing 108 within the wellbore 104. As mentioned above, more than one string of casing 108 may be secured within the wellbore 104, such as two or more strings of casing 108 that overlap each other or are otherwise concentrically positioned.

Along with most portions of the wellbore 104, the casing 108 may be properly bonded to the cement 204 or other materials at the interface between the two components. In some locations, however, the bond between the casing 108 and the cement 204 or other materials may be poor or may fail over time and it may be desired to analyze annular materials 206 disposed within the annulus 202 to determine whether or not the bond between the casing 108 and the cement 204 remains intact. According to embodiments of the present disclosure, the logging tools 118 (FIG. 1) included in the tool string 114 may be used to determine a compositional equivalent for the annular material 206 disposed in the annulus 202 and thereby determine axial locations along the wellbore 104 where the casing 108 may or may not be properly bonded to the cement 201 or other materials.

As used herein, the term "compositional equivalent" refers a category to which the annular material 206 can be assigned and can include a gas, a liquid, a settled mud solid (i.e. barite), or cement. Accordingly, while depicted in FIG. 2 as separate from the cement 204, in some cases, the annular material 206 may comprise a portion of the cement 204, thereby indicating that the bond between the casing 108 and the cement 204 remains intact. If, however, the compositional equivalent of the annular material 206 is one of a gas, a liquid, or a settled mud solid, it may be ascertained that the bond between the casing 108 and the cement 204 has failed at that location. Likewise, materials other than the cement 204 may have accumulated in intervals previously not isolated by the cement 204 or in un-bonded portions of the annulus 202. This may create bonded intervals beyond the originally cemented portions of the well.

As the tool string 114 traverses the wellbore 104, one or more centralizers 208 may operate to centralize the tool string 114 within the wellbore 104. The centralizers 208 may comprise, for example, leaf spring or bow spring centralizers, but could alternatively be any other type of downhole tool centralizing device. In other embodiments, however, it may be desired to have all or a portion of the tool string 114 decentralized or recentered in the wellbore 104 such that a desired standoff from the casing 108 is achieved for measurement optimizations. In such embodiments, the centralizers 208 may be omitted or may alternatively be actuatable so that the tool string 114 may be selectively placed at desired radial distances from the casing 108.

As mentioned above, the tool string 114 may include a plurality of logging tools 118 (FIG. 1), which may include, but are not limited to, a cement bond logging tool 210, a circumferential acoustic scanning tool 212, and at least two nuclear tools shown as a spectral density logging tool 214 and a dual spaced neutron tool 216. As also mentioned above, the logging tools 118 may be expanded to include other known sensors such as, but not limited to, an epithermal neutron sensor, a rotating gamma-density sensor, a pulsed neutron sensor, an advanced acoustic logging tool with multiple excitation abilities (monopole, dipole, quadrapole, multi-pole), elemental capture gamma ray sensors or the like, without departing from the scope of the disclosure. During operation within the wellbore 104, each of the logging tools 210, 212, 214, 216 may be configured to obtain measurements that help determine the compositional equivacombinationnnular material 206, whether it be cement 204 or one of a gas, a liquid, a settled mud solid, or any combination of thereof.

The cement bond logging tool 210 may comprise an omni-directional and sectored/segmented logging tool configured to provide acoustic refracted waveform measurements. In some embodiments, the cement bond logging tool 210 may operate as a pitch-and-catch transducer. More particularly, the cement bond logging tool 210 may include a source transmitter 218 and two or more detectors 220*a* and 220*b*, which may be arranged in a pitch and catch configuration. That is, the source transmitter 218 may act as a pitch transducer, and the detectors 220*a, b* may act as near and far catch transducers spaced at suitable near and far axial distances from the source transmitter 218, respectively. In such a configuration, the source transmitter 218 emits acoustic waves 222 while the near and far detectors 220*a, b* receive acoustic refracted waveforms 223 after reflection from fluid in the wellbore 104, the casing 108, the cement 204, and the formation 106 and record the received waveforms 223 as time domain waveforms.

Because the distance between the near and far detectors 220*a, b* is known, differences between the refracted waveforms 223 received at each detector 220*a,b* provides information about attenuation that can be correlated to the annular material 206 in the annulus 202, and they allow a circumferential depth of investigation around the wellbore 104.

The pitch-catch transducer pairing may have different frequency, spacing, and/or angular orientations based on environmental effects and/or tool design. For example, if the source transmitter 218 and the detectors 220*a* and 220*b* operate in the sonic range, spacing that ranges from three to fifteen feet may be appropriate. If, however, the source transmitter 218 and the detectors 220*a* and 220*b* operate in the ultrasonic range, the spacing may be reduced.

In addition, or as an alternative to the pitch-and-catch configuration of the source transmitter 218 and the detectors 220*a* and 220*b*, the cement bond logging tool 210 may also include a pulsed echo ultrasonic transducer (not expressly shown). The pulsed echo ultrasonic transducer may, for instance, operate at a frequency from 80 kHz up to 800 kHz. The optimal transducer frequency is a function of the casing 108 size, weight, mud environment and other conditions. The pulsed echo ultrasonic transducer transmits waves, receives the same waves after they reflect off casing 108, materials in the annulus 202, and the formation 106, and records the waves as time-domain waveforms.

The use of sonic, pulsed echo ultrasonic, and pitch and catch waveforms have historically been used to evaluate the annulus 202 for the presence of cement 204 (a cement sheath) or a lack thereof. The acoustic waves 222 use the amplitude of the first arrival, attenuation of the refracted waveforms 223 using multiple the near and far detectors 220*a, b*, and a recorded waveform to determine the amount of cement 204. The pulsed echo ultrasonic and pitch and catch waveforms are processed using various methods to determine the impedance of the materials in the annulus 202, and evaluation of the impedance data may be used to help determine the distribution and compositional equivalent of the annular material 206 over the circumferential exterior surface of the casing 108 within the annulus 202. It will be appreciated, however, that evaluating the annular material 206 may not be limited to the above-described methods but may alternatively include other proprietary techniques based on tool design and methodology.

The standard sonic, pulsed echo ultrasonic, and pitch and catch waveforms may be processed by referencing the peaks and troughs of the waveforms to help characterize the annular material 206 in the annulus 202. Such processing and analysis are sometimes referred to as peak analysis for cement evaluation (PACE). Waveforms have a completely different signature when the annulus 202 is filled with a fluid (i.e., free pipe or casing 108) or a solid (i.e., cement 204), and variations associated with other materials, such as drilling muds and settled mud solids. The free pipe signature, for instance, generally exhibits higher amplitudes, a low rate of attenuation and a consistent waveform response. When the annulus 202 is filled with a solid material, however, such as the cement 204, the amplitude of the waveform is reduced, the attenuation of the same waveform is increased, and the waveforms are not consistent. PACE evaluates the peaks and troughs of these waveforms using a standard methodology for various acoustic measurement systems with different types of waveforms.

More specifically, this new technique uses the peaks and troughs of the waveform for analysis and a derivative process is subsequently used to determine the peaks and troughs. Locations where the derivative changes sign corresponds to the peak or trough of that waveform, and the value of the waveform will be called a peak. This provides an automatic method of picking both the positive and negative peaks of the entire waveform. The next step is to take the absolute value of each peak. At that point, it is possible to start seeing some general trends in the data of each waveform, and various groupings or sections appear. It is also possible to stack these waveforms to highlight these groupings.

Using the above sequence of steps, various patterns begin to emerge from both the free and bonded sections of the wellbore 104. There are four or more distinct areas (regions) or breaks in the waveform response and can be sorted or studied based on these breaks. Each area or break can be adjusted or shifted based on the waveform response, casing size, casing weight, cement properties, and other environmental conditions of the well.

It is apparent that the first region is the casing 108 arrivals, while the fifth region constitutes arrivals derived from the formation 106. The other regions encompass the area between casing 108 and the formation 106 (i.e., the annulus 202). The second and fourth regions, for example, appear to be influenced by casing 108 and the formation 106, respectively, and can be analyzed at a future time. The third region may also be influenced by the surrounding regions, but by what effect is not necessarily clear. This grouping of regions may be a function of environmental and tool conditions but has been recognized by both the standard cement bond log and the radial bond cement bond log, which operate at different frequencies.

Once the regions are selected, the area under each waveform for each region is determined. The area of the first region is calculated without using the first positive peak.

This is due to the fact that the first positive peak is always smaller than subsequent peaks, and so removing this naturally low peak allows easier comparison to the other areas. These areas are then normalized to 100% free pipe and color-coded to allow easier viewing. This is somewhat similar to using the amplitude of waveforms to determine bonding, but multiple peaks are used instead of using a single cycle.

The circumferential acoustic scanning tool 212 may obtain ultrasonic measurements of the annular material 206 by using a rotating transducer to emit high-frequency acoustic pulses that are reflected from fluid in the wellbore 104, the casing 108, the cement 204, and the formation 106. The transducer senses the reflected pulses, and an associated logging system measures and records reflected pulse amplitude and two-way travel time. These data can be processed to produce detailed visual images of casing 108, the cement 204, and beyond. Suitable tools that may be used as the circumferential acoustic scanning tool 212 include, but are not limited to, the line of circumferential acoustic scanning tools (CAST) available from Halliburton Energy Services of Houston, Texas (e.g., CAST-I™, CAST-V™, CAST-M™, CAST-XR™, FASTCAST™, etc.).

The spectral density logging tool 214 may comprise a type of nuclear logging tool. In some embodiments, as illustrated, the spectral density logging tool 214 may include one or more actuatable arms 224 that may be selectively extended to move associated measurement sensors or detectors from a closed pad position to varying eccentric positions within the wellbore 104. As will be appreciated, this allows multiple depths of radial measurement within the wellbore 104, which is especially beneficial in evaluating wells that contain multiple concentric strings of casing 108. It is also easy to configure individual sensors in eccentric or decentralized configurations for specific geometries or customized situations. In the illustrated embodiment, the actuatable arm(s) 224 are extended to place the sensors or detectors of the spectral density logging tool 214 in direct engagement with the inner wall of the casing 108, or retracted when the density tool is in the "pad-closed" position. Additionally, dual spaced neutron tool 216 may be configured to acquire a neutron log of wellbore 104. In addition, dual spaced neutron tool 216 may comprise or more centralizers 208.

Figure 3:
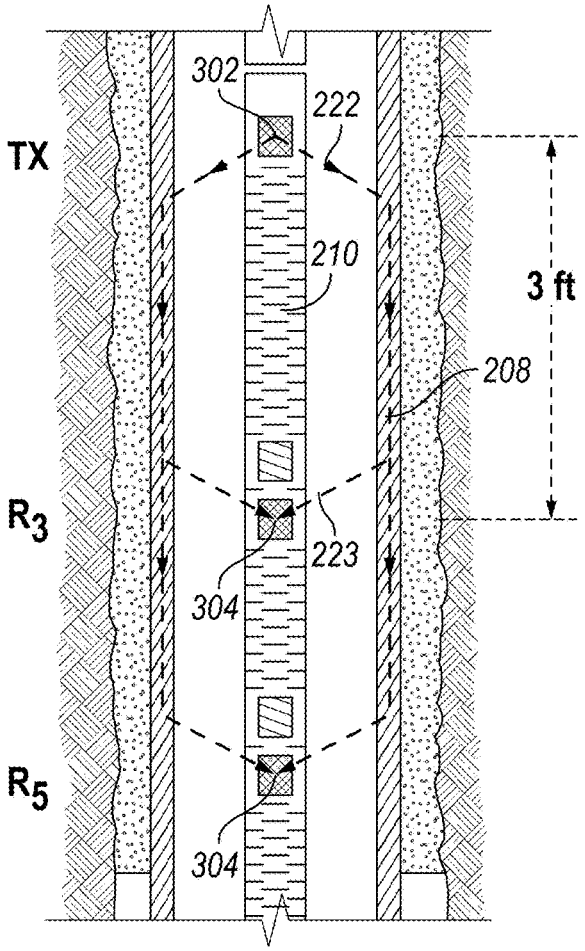
FIG. 3 illustrates a traditional example of cement bond logging tool.
Figure 4:
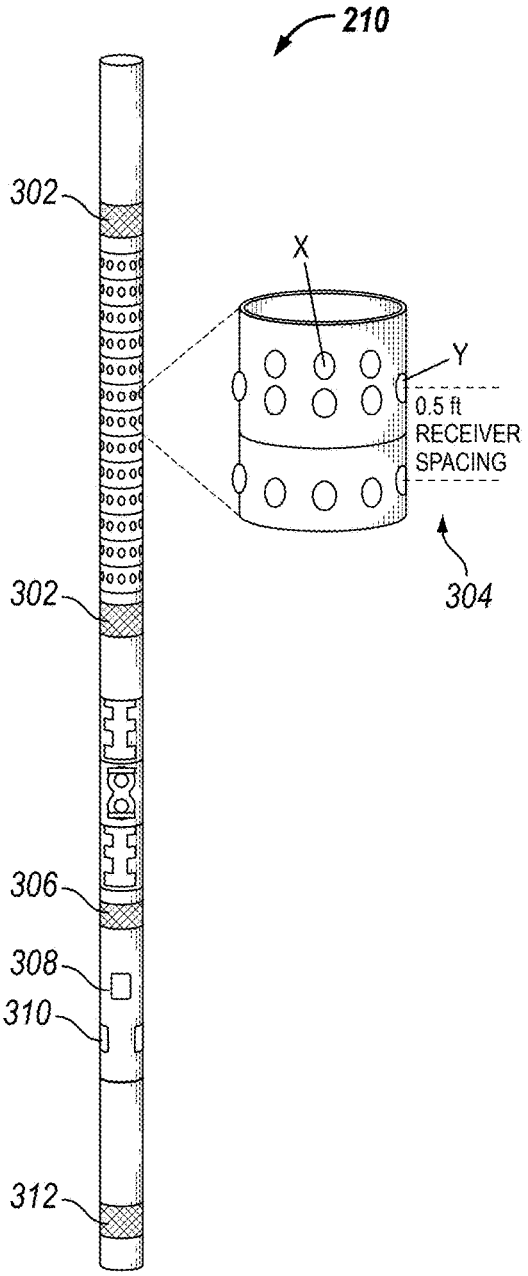
FIG. 4 illustrates a new example of cement bond logging tool.

FIG. 3 illustrates a traditional example of cement bond logging tool 210. In examples, transmitter 302 may emit acoustic wave 222 into casing 108. Then, refracted waveform 223 may be observed with receiver array 304. In examples, the spacing for the traditional cement bond log (CBL) tools may be three feet between the nearest receiver in receiver array 304 and transmitter 302. In addition, receiver array 304 and transmitter 302 may be in line (along the same axial axis) with another. FIG. 4 illustrates a new example of cement bond logging tool 210 comprising standard orientation and spacing for receiver array 304 and transmitters 302. In addition, every receiver in receiver array 304 may be spaced 0.5 ft away. Cement bond logging tool 210 may also comprise far monopole 306, dipole X 308, dipole Y 310, and/or upper far monopole 312.

Figure 5:
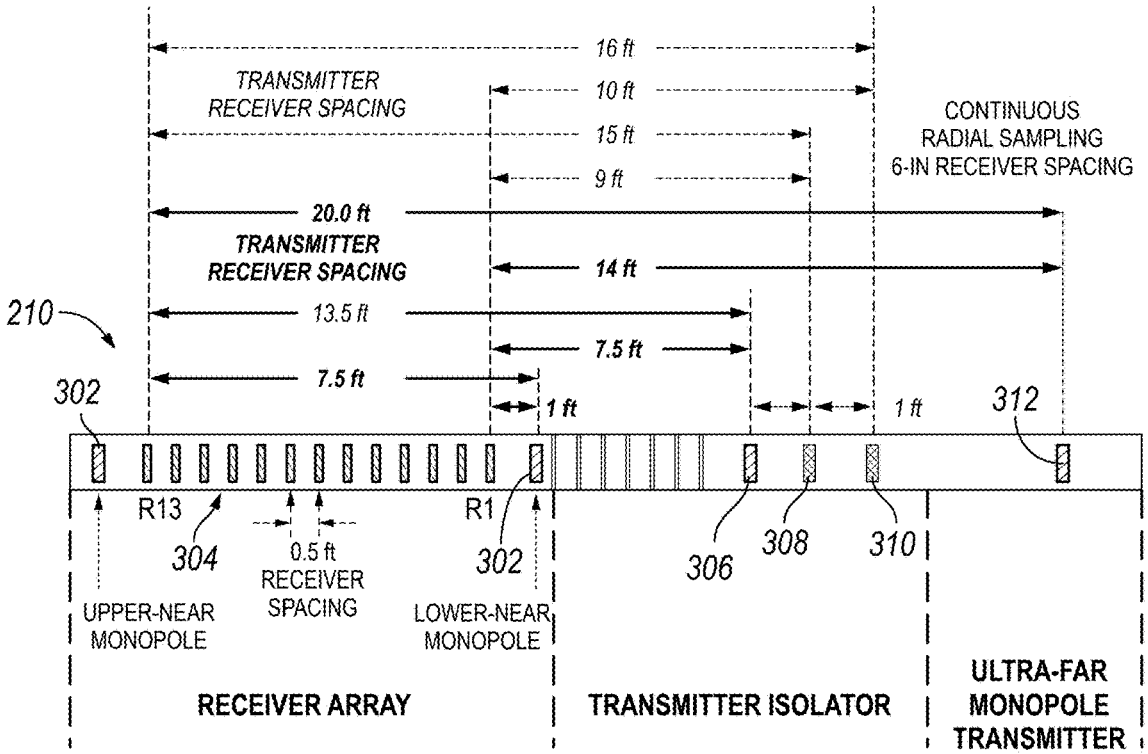
FIG. 5 illustrates cement bond logging tool with two transmitters of an upper-near monopole and lower-near monopole and receivers.

FIG. 5 illustrates cement bond logging tool 210 with two transmitters 302 of an upper-near monopole and lower-near monopole and receiver array 304 as R1-R13. The spacing between transmitter 302 for the upper-near monopole and the nearest receiver from receiver array 304 may be 1 foot. Similarly, spacing between transmitter 302 for the lower-near monopole and the nearest receiver from receiver array 304 may be 1 foot. Herein, the spacing illustrated may be defined as along the dimension of the axial length of the tool. In addition, spacings depicted from the center of the component of the tool to the next center component of the tool. In addition, far monopole 306 may be 7.5 feet from R1 or 13.5 feet from R13. Dipole X 308 may be 9 feet from R1 and 15 feet from R13. Dipole Y 310 may be 10 feet from R1 and 16 feet from R16. Upper far monopole 312 may be 14 feet from R1 and 20 feet from R13.

Figure 6:
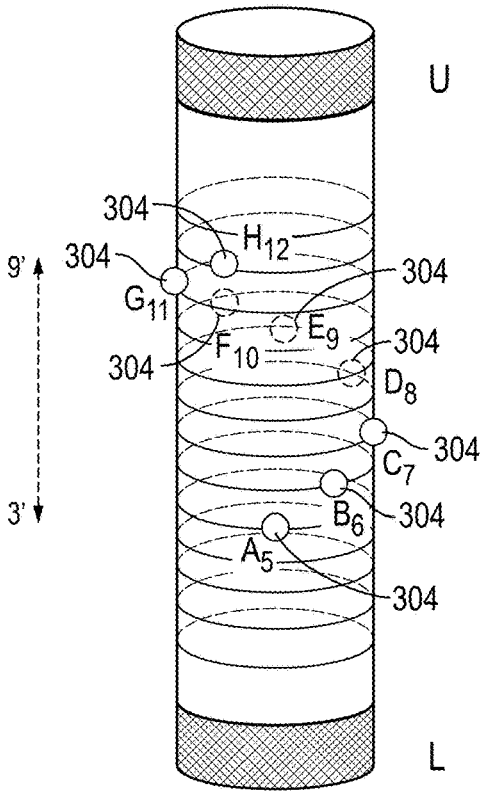
FIG. 6 illustrates an orientation of receivers spaced along cement bond logging tool.

FIG. 6 illustrates an orientation of receiver array 304 spaced along cement bond logging tool 210. In examples, receiver array 304 may be spaced out 45 degrees and every 6 inches from the 3-foot station to the 9-foot station. Herein, receiver array 304 may be hydrophones or any other device configured to receive acoustic waves. When receiver array 304 are hydrophones, they may be disposed on the outer radius of cement bond logging tool 210. Further, receiver array 304 may be defined as a helical array. In examples, the nearest monopole transmitter to the nearest hydrophone receiver station is spaced at 1 foot. The receiver stations extend away at 6-inch increments for a total of 13 individual stations having 8 sensors at each station to a distance 7 feet from the nearest monopole transmitter. By using multiple monopole transmitters, a measured receiver signal is taken from 1 foot to 20 feet distances every 6 inches between monopole transmission to reception. Likewise, dipole measurements are achieved from 9 feet to 16 feet every 6 inches between dipole transmission and reception. the same axial relative location the receivers are evaluated for comparison between offset receivers in the next array moving spirally in 45-degree increments. The method provides sampling and evaluation at selectable receiver station levels spaced as desired through the hydrophone receiver array.

For example, sampling and using methods similar to the established PACERS can be applied to compare signals detected at all 8 sensors of the 3 foot spacing (transmitter-receiver) and compare signal character of the 4 foot receiver station for relative amplitude attenuation on the in-line axis 3 foot to 4 foot sensors as well as the 3 foot station sensor compared to the 45 degree offset sensors of the 4 foot station. Likewise, comparison of signal character of the 5-foot receiver station for relative amplitude attenuation on the in-line axis 3 foot to 5 foot sensors as well as the 3 foot station sensor compared to the 45 degree offset sensors of the 5 foot station.

Similarly, the comparison of signal character of the 5-foot receiver station for relative amplitude attenuation on the in-line axis 4 foot to 5 foot sensors as well as the 4 foot station sensor compared to the 45 degree offset sensors of the 5 foot station. Through similar logic the method can evaluate signal character between any desired receiver of the tool array and develop a volume or shell evaluation of acoustic energy transmission surrounding the tool. From this an interpretation based on signal laboratory and mathematically modeled response can derive an interpretation of annular contents in first annulus and beyond into multiple concentric annular regions in wellbore 104.

Figure 7A:
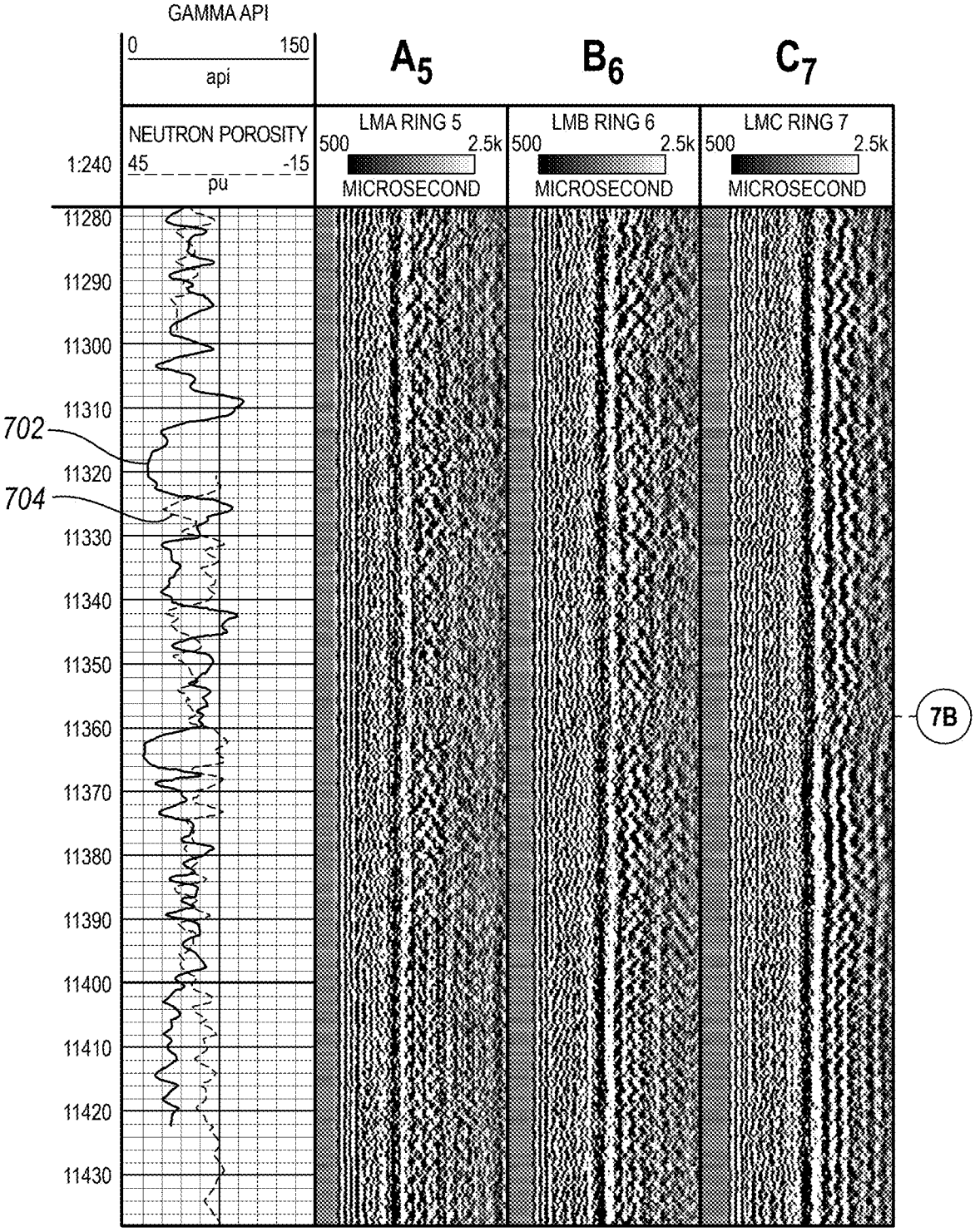
FIG. 7A illustrates channels $A_5$-$C_7$ in the receiver array.
Figure 7B:
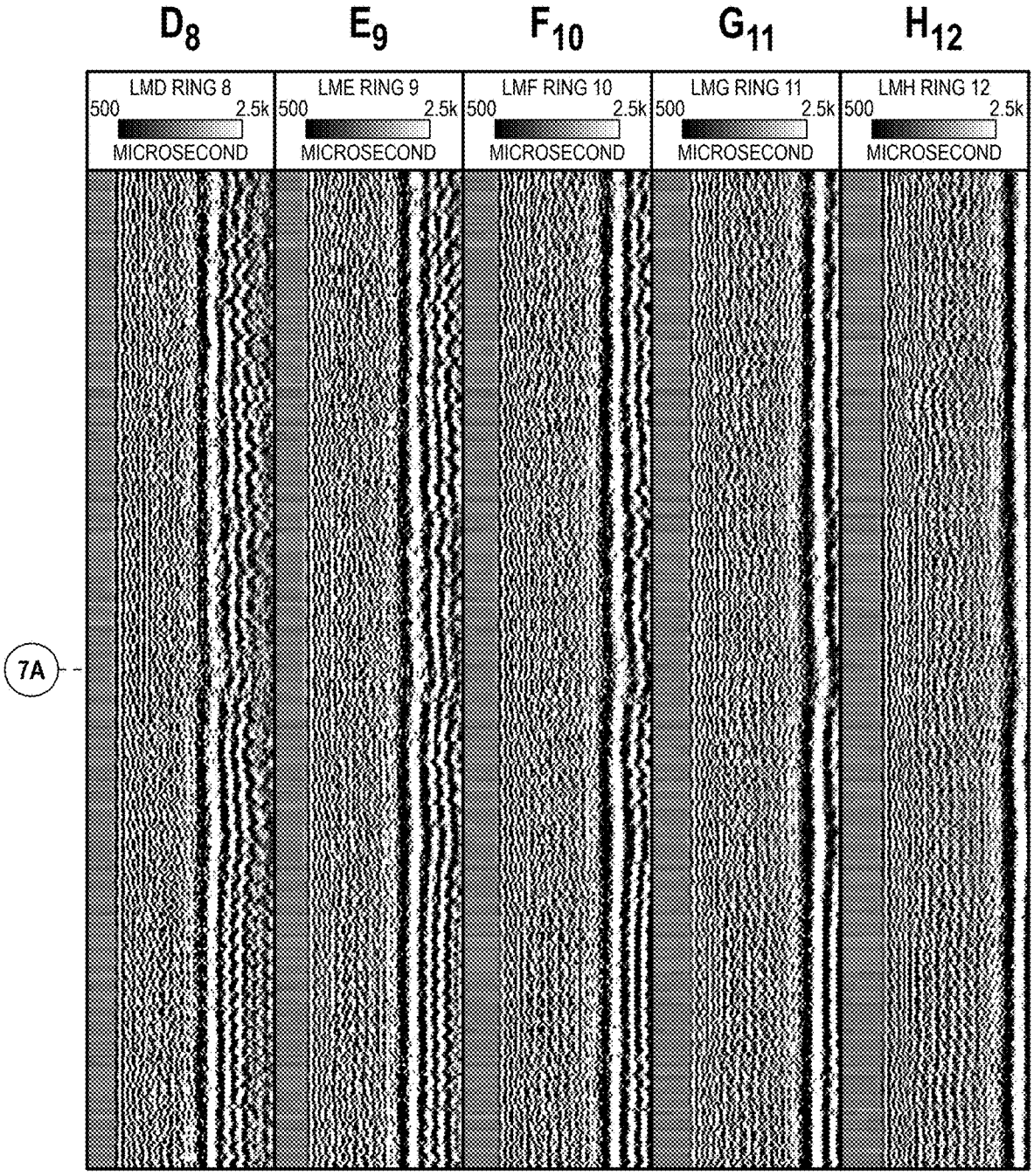
FIG. 7B illustrates channels $D_8$-$H_{12}$ in the receiver array.

FIG. 7A illustrates channels $A_5$-$C_7$ in receiver array 304 (e.g., referring to FIG. 6) as illustrated in FIG. 6. In addition, FIG. 7A illustrates spectral density log 702 and neutron log 704. FIG. 7B illustrates channels $D_8$-$H_{12}$ in receiver array 304 (e.g., referring to FIG. 6) as illustrated in FIG. 6. A fast Fourier transform (FFT) may process each channel into cement bond property log. For example, multichannel multimode dispersion analysis (Matrix Pencil, Prony, or Modified DPFS) may be performed to extract all dispersion from every channel for each receiver of receiver array 304. With the dispersions, an FFT may be applied for every channel to yield a cement bond property log. In examples, cement bond property log may be fully bonded, partially bonded (and to what extent), or free pipe. In addition, one or more filters may be applied to enhance the measurements. Processing may be performed on information handling system 126 (e.g., referring to FIG. 1). In addition, spectral density log 702 and neutron log 704 may also be utilized. Further, baseline measurements may be utilized to enhance the processing for the cement bond property log. Herein, baseline measurements may correspond to measurements obtained during the calibration phase of the tool, in a controlled environment, in a known fluid, with a known distance between the transmitters and the 1st interface being measured (internal wall of a test casing, or a test jig during calibration). Measurements obtained during logging in a downhole environment are then compared to the baseline measurement to ensure accuracy and repeatability.

Well interventions may be performed based on the cement bond property log. Well intervention decisions may be operations to repair casing, remove casing, patch defects, and/or remove defects within the casing. In expels, repairing casing and/or defects may be performed by any suitable means, for example, inserting repair sleeves, adding concrete, and/or the like.

Figure 8:
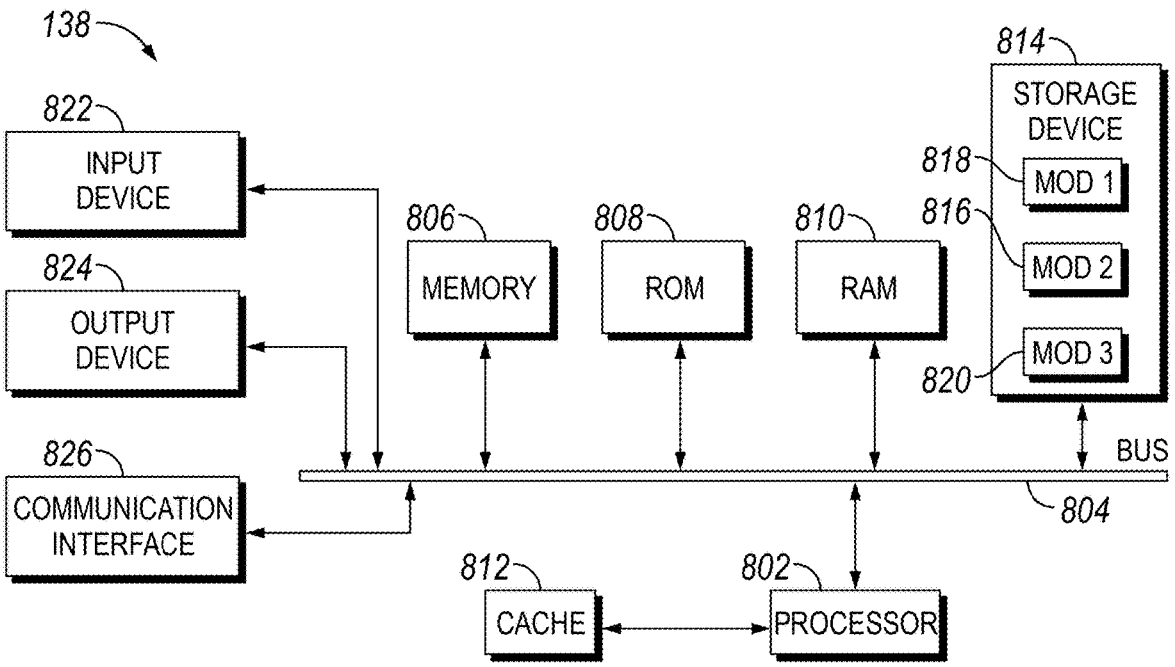
FIG. 8 illustrates an example information handling system.

FIG. 8 illustrates an example information handling system 126 which may be employed to perform various steps, methods, and techniques disclosed herein. Persons of ordinary skill in the art will readily appreciate that other system examples are possible. As illustrated, information handling system 126 includes a processing unit (CPU or processor) 802 and a system bus 804 that couples various system components including system memory 806 such as read only memory (ROM) 808 and random-access memory (RAM) 810 to processor 802. Processors disclosed herein may all be forms of this processor 802. Information handling system 126 may include a cache 812 of high-speed memory connected directly with, in close proximity to, or integrated as part of processor 802. Information handling system 126 copies data from memory 806 and/or storage device 814 to cache 812 for quick access by processor 802. In this way, cache 812 provides a performance boost that avoids processor 802 delays while waiting for data. These and other modules may control or be configured to control processor 802 to perform various operations or actions. Another system memory 806 may be available for use as well. Memory 806 may include multiple different types of memory with different performance characteristics. It may be appreciated that the disclosure may operate on information handling system 126 with more than one processor 802 or on a group or cluster of computing devices networked together to provide greater processing capability. Processor 802 may include any general-purpose processor and a hardware module or software module, such as first module 818, second module 816, and third module 820 stored in storage device 814, configured to control processor 802 as well as a special-purpose processor where software instructions are incorporated into processor 802. Processor 802 may be a self-contained computing system, containing multiple cores or processors, a bus, memory controller, cache, etc. A multi-core processor may be symmetric or asymmetric. Processor 802 may include multiple processors, such as a system having multiple, physically separate processors in different sockets, or a system having multiple processor cores on a single physical chip. Similarly, processor 802 may include multiple distributed processors located in multiple separate computing devices but working together such as via a communications network. Multiple processors or processor cores may share resources such as memory 806 or cache 812 or may operate using independent resources. Processor 802 may include one or more state machines, an application specific integrated circuit (ASIC), or a programmable gate array (PGA) including a field PGA (FPGA).

Each individual component discussed above may be coupled to system bus 804, which may connect each and every individual component to each other. System bus 804 may be any of several types of bus structures including a memory bus or memory controller, a peripheral bus, and a local bus using any of a variety of bus architectures. A basic input/output (BIOS) stored in ROM 808 or the like, may provide the basic routine that helps to transfer information between elements within information handling system 126, such as during start-up. Information handling system 126 further includes storage devices 814 or computer-readable storage media such as a hard disk drive, a magnetic disk drive, an optical disk drive, tape drive, solid-state drive, RAM drive, removable storage devices, a redundant array of inexpensive disks (RAID), hybrid storage device, or the like. Storage device 814 may include software modules of second, first, and third software modules 816, 818, and 820 for controlling processor 802. Information handling system 126 may include other hardware or software modules. Storage device 814 is connected to the system bus 804 by a drive interface. The drives and the associated computer-readable storage devices provide nonvolatile storage of computer-readable instructions, data structures, program modules and other data for information handling system 126. In one aspect, a hardware module that performs a particular function includes the software component stored in a tangible computer-readable storage device in connection with the necessary hardware components, such as processor 802, system bus 804, and so forth, to carry out a particular function. In another aspect, the system may use a processor and computer-readable storage device to store instructions which, when executed by the processor, cause the processor to perform operations, a method or other specific actions. The basic components and appropriate variations may be modified depending on the type of device, such as whether information handling system 126 is a small, handheld computing device, a desktop computer, or a computer server. When processor 802 executes instructions to perform "operations", processor 802 may perform the operations directly and/or facilitate, direct, or cooperate with another device or component to perform the operations.

As illustrated, information handling system 126 employs storage device 814, which may be a hard disk or other types of computer-readable storage devices which may store data that are accessible by a computer, such as magnetic cassettes, flash memory cards, digital versatile disks (DVDs), cartridges, random access memories (RAMs) 810, read only memory (ROM) 808, a cable containing a bit stream and the like, may also be used in the exemplary operating environment. Tangible computer-readable storage media, computer-readable storage devices, or computer-readable memory devices, expressly exclude media such as transitory waves, energy, carrier signals, electromagnetic waves, and signals per se.

To enable user interaction with information handling system 126, an input device 822 represents any number of input mechanisms, such as a microphone for speech, a touch-sensitive screen for gesture or graphical input, keyboard, mouse, motion input, speech and so forth. Additionally, input device 822 may take in data from measurement assembly 134, discussed above. An output device 824 may also be one or more of a number of output mechanisms known to those of skill in the art. In some instances, multimodal systems enable a user to provide multiple types of input to communicate with information handling system 126. Communications interface 826 generally governs and manages the user input and system output. There is no restriction on operating on any particular hardware arrangement and therefore the basic hardware depicted may easily be substituted for improved hardware or firmware arrangements as they are developed.

As illustrated, each individual component described above is depicted and disclosed as individual functional blocks. The functions these blocks represent may be provided through the use of either shared or dedicated hardware, including, but not limited to, hardware capable of executing software and hardware, such as a processor 802, that is purpose-built to operate as an equivalent to software executing on a general-purpose processor. For example, the functions of one or more processors presented in FIG. 8 may be provided by a single shared processor or multiple processors. (Use of the term "processor" should not be construed to refer exclusively to hardware capable of executing software.) Illustrative embodiments may include microprocessor and/or digital signal processor (DSP) hardware, read-only memory (ROM) 808 for storing software performing the operations described below, and random-access memory (RAM) 810 for storing results. Very large-scale integration (VLSI) hardware embodiments, as well as custom VLSI circuitry in combination with a general-purpose DSP circuit, may also be provided.

The logical operations of the various methods, described below, are implemented as: (1) a sequence of computer implemented steps, operations, or procedures running on a programmable circuit within a general use computer, (2) a sequence of computer implemented steps, operations, or procedures running on a specific-use programmable circuit; and/or (3) interconnected machine modules or program engines within the programmable circuits. Information handling system 126 may practice all or part of the recited methods, may be a part of the recited systems, and/or may operate according to instructions in the recited tangible computer-readable storage devices. Such logical operations may be implemented as modules configured to control processor 802 to perform particular functions according to the programming of software modules 816, 818, and 820.

In examples, one or more parts of the example information handling system 126, up to and including the entire information handling system 126, may be virtualized. For example, a virtual processor may be a software object that executes according to a particular instruction set, even when a physical processor of the same type as the virtual processor is unavailable. A virtualization layer or a virtual "host" may enable virtualized components of one or more different computing devices or device types by translating virtualized operations to actual operations. Ultimately however, virtualized hardware of every type is implemented or executed by some underlying physical hardware. Thus, a virtualization computer layer may operate on top of a physical computer layer. The virtualization computer layer may include one or more virtual machines, an overlay network, a hypervisor, virtual switching, and any other virtualization application.

Figure 9:
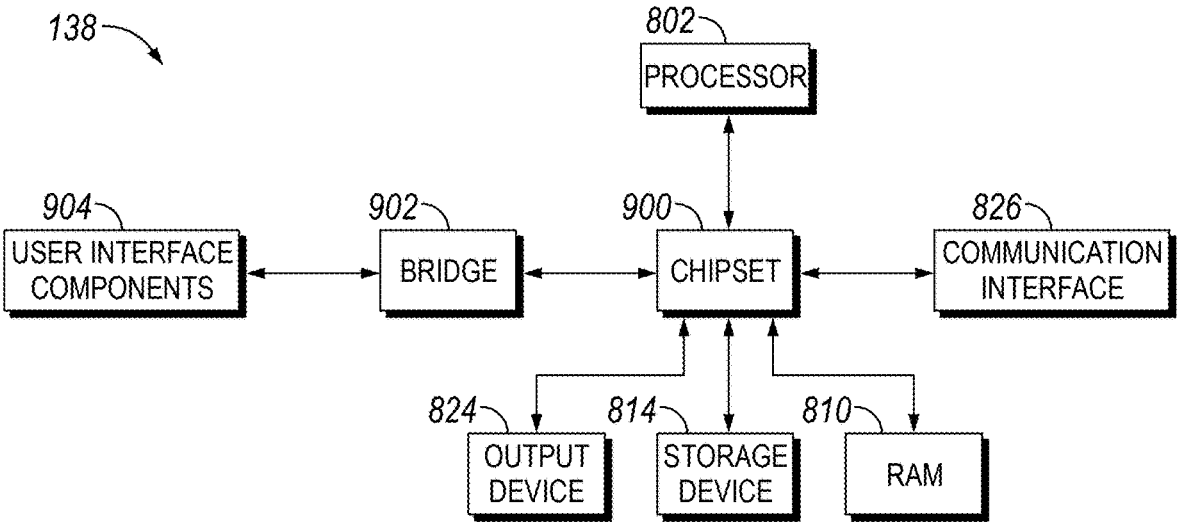
FIG. 9 illustrates another example information handling system.

FIG. 9 illustrates an example information handling system 126 having a chipset architecture that may be used in executing the described method and generating and displaying a graphical user interface (GUI). Information handling system 126 is an example of computer hardware, software, and firmware that may be used to implement the disclosed technology. Information handling system 126 may include a processor 802, representative of any number of physically and/or logically distinct resources capable of executing software, firmware, and hardware configured to perform identified computations. Processor 802 may communicate with a chipset 900 that may control input to and output from processor 802. In this example, chipset 900 outputs information to output device 824, such as a display, and may read and write information to storage device 814, which may include, for example, magnetic media, and solid-state media. Chipset 900 may also read data from and write data to RAM 810. Bridge 902 for interfacing with a variety of user interface components 904 may be provided for interfacing with chipset 900. User interface components 904 may include a keyboard, a microphone, touch detection and processing circuitry, a pointing device, such as a mouse, and so on. In general, inputs to information handling system 126 may come from any of a variety of sources, machine generated and/or human generated.

Chipset 900 may also interface with one or more communication interfaces 826 that may have different physical interfaces. Such communication interfaces may include interfaces for wired and wireless local area networks, for broadband wireless networks, as well as personal area networks. Some applications of the methods for generating, displaying, and using the GUI disclosed herein may include receiving ordered datasets over the physical interface or be generated by the machine itself by processor 802 analyzing data stored in storage device 814 or RAM 810.

Further, information handling system 126 receives inputs from a user via user interface components 904 and executes appropriate functions, such as browsing functions by interpreting these inputs using processor 802.

In examples, information handling system 126 may also include tangible and/or non-transitory computer-readable storage devices for carrying or having computer-executable instructions or data structures stored thereon. Such tangible computer-readable storage devices may be any available device that may be accessed by a general purpose or special purpose computer, including the functional design of any special purpose processor as described above. By way of example, and not limitation, such tangible computer-readable devices may include RAM, ROM, EEPROM, CD-ROM or other optical disk storage, magnetic disk storage or other magnetic storage devices, or any other device which may be used to carry or store desired program code in the form of computer-executable instructions, data structures, or processor chip design. When information or instructions are provided via a network, or another communications connection (either hardwired, wireless, or combination thereof), to a computer, the computer properly views the connection as a computer-readable medium. Thus, any such connection is properly termed a computer-readable medium. Combinations of the above should also be included within the scope of the computer-readable storage devices.

Computer-executable instructions include, for example, instructions and data which cause a general-purpose computer, special purpose computer, or special purpose processing device to perform a certain function or group of functions. Computer-executable instructions also include program modules that are executed by computers in standalone or network environments. Generally, program modules include routines, programs, components, data structures, objects, and the functions inherent in the design of special-purpose processors, etc. that perform particular tasks or implement particular abstract data types. Computer-executable instructions, associated data structures, and program modules represent examples of the program code means for executing steps of the methods disclosed herein.

The particular sequence of such executable instructions or associated data structures represents examples of corresponding acts for implementing the functions described in such steps.

In additional examples, methods may be practiced in network computing environments with many types of computer system configurations, including personal computers, hand-held devices, multi-processor systems, microprocessor-based or programmable consumer electronics, network PCs, minicomputers, mainframe computers, and the like. Examples may also be practiced in distributed computing environments where tasks are performed by local and remote processing devices that are linked (either by hard-wired links, wireless links, or by a combination thereof) through a communications network. In a distributed computing environment, program modules may be located in both local and remote memory storage devices.

Figure 10:
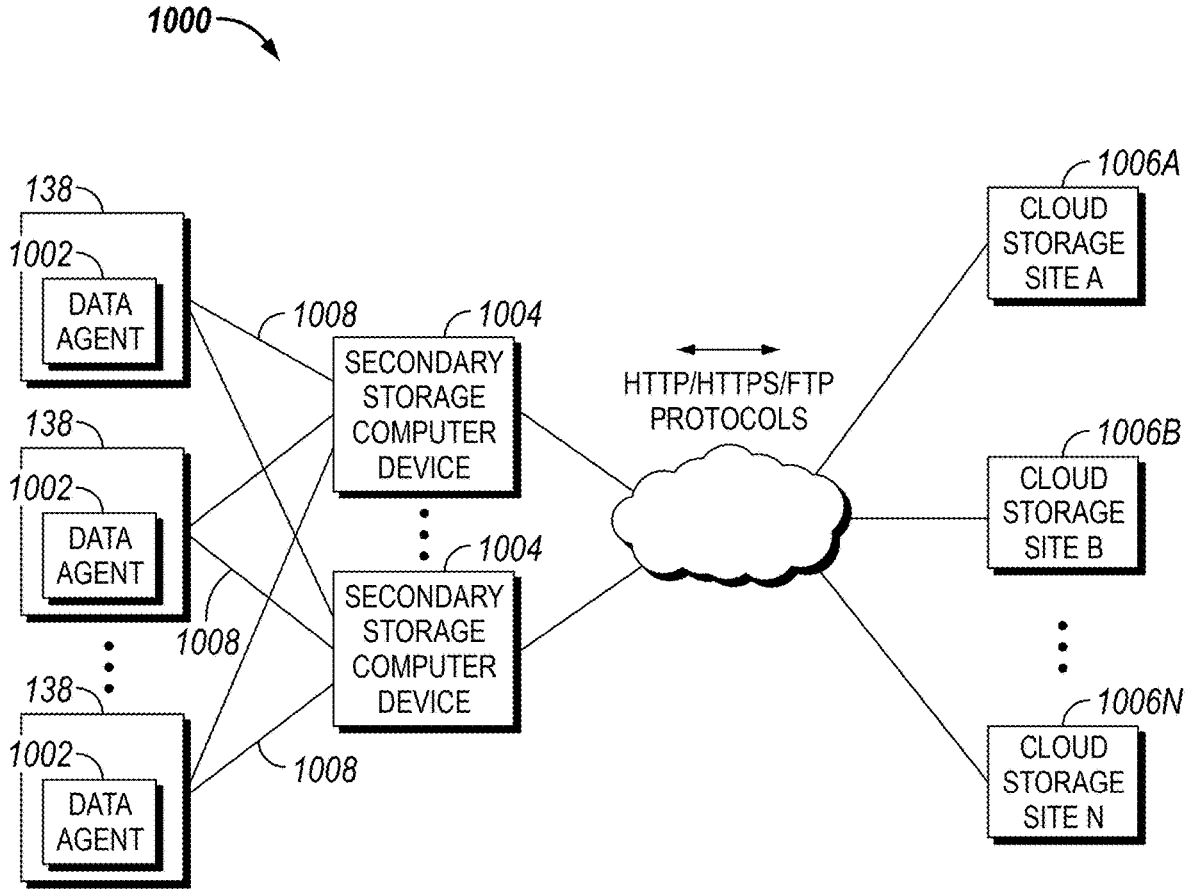
FIG. 10 illustrates an example of one arrangement of resources in a computing network.

FIG. 10 illustrates an example of one arrangement of resources in a computing network 1000 that may employ the processes and techniques described herein, although many others are of course possible. As noted above, an information handling system 126, as part of their function, may utilize data, which includes files, directories, metadata (e.g., access control list (ACLS) creation/edit dates associated with the data, etc.), and other data objects. The data on the information handling system 126 is typically a primary copy (e.g., a production copy). During a copy, backup, archive or other storage operation, information handling system 126 may send a copy of some data objects (or some components thereof) to a secondary storage computing device 1004 by utilizing one or more data agents 1002.

A data agent 1002 may be a desktop application, website application, or any software-based application that is run on information handling system 126. As illustrated, information handling system 126 may be disposed at any rig site (e.g., referring to FIG. 1) or repair and manufacturing center. Data agent 1002 may communicate with a secondary storage computing device 1004 using communication protocol 1008 in a wired or wireless system. Communication protocol 1008 may function and operate as an input to a website application. In the website application, field data related to pre- and post-operations, generated DTCs, notes, and the like may be uploaded. Additionally, information handling system 126 may utilize communication protocol 1008 to access processed measurements, operations with similar DTCs, troubleshooting findings, historical run data, and/or the like. This information is accessed from secondary storage computing device 1004 by data agent 1002, which is loaded on information handling system 126.

Secondary storage computing device 1004 may operate and function to create secondary copies of primary data objects (or some components thereof) in various cloud storage sites 1006A-N. Additionally, secondary storage computing device 1004 may run determinative algorithms on data uploaded from one or more information handling systems 126, discussed further below. Communications between the secondary storage computing devices 1004 and cloud storage sites 1006A-N may utilize REST protocols (Representational state transfer interfaces) that satisfy basic C/R/U/D semantics (Create/Read/Update/Delete semantics), or other hypertext transfer protocol ("HTTP")-based or file-transfer protocol ("FTP")-based protocols (e.g., Simple Object Access Protocol).

In conjunction with creating secondary copies in cloud storage sites 1006A-N, the secondary storage computing device 1004 may also perform local content indexing and/or local object-level, sub-object-level or block-level deduplication when performing storage operations involving various cloud storage sites 1006A-N. Cloud storage sites 1006A-N may further record and maintain DTC code logs for each downhole operation or run, map DTC codes, store repair and maintenance data, store operational data, and/or provide outputs from determinative algorithms that are fun at cloud storage sites 1006A-N.

The methods and systems described above are improvements over current technology. For example, the helical receiver design may provide a comprehensive 360 degree image of the borehole, regardless of tool positioning within the wellbore, and can help to offset the effects of tool eccentralization (where the tool is not perfectly centralized in the casing during logging), providing more reliable wellbore imaging. An improvement in the art is DOI, or depth of investigation. In examples, the 3' and 5' receivers or $A_5$ and $E_9$ receivers from receiver array 304 may be combined to provide a collaborative measurement. In contrast, the standard CBL measures casing bond as a function of amplitude at the 3' receiver and the 5' receiver provides a deeper depth of investigation (distance away from the wellbore center) while confirming the 3' receiver answer and also provides a variable density log waveform display.

The preceding description provides various examples of the systems and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps, the compositions and methods may also "consist essentially of" or "consist of" the various components and steps. Moreover, the indefinite articles "a" or "an," as used in the claims, are defined herein to mean one or more than one of the elements that it introduces. The systems and methods may comprise any of the various features disclosed herein, comprising one or more of the following statements.

Statement 1. A system comprising: a cement bond logging tool comprising: two or more transmitters configured to transmit an acoustic wave from cement bond logging tool; and an array of receivers configured to receive a refracted waveform; and an information handling system configured to process the refracted waveform from the array of receivers into a cement bond property log.

Statement 2. The system of statement 1, wherein the array of receivers comprises a first hydrophone and a second hydrophone.

Statement 3. The system of statement 2, wherein the two or more transmitters comprise an upper-near monopole and a lower-near monopole.

Statement 4. The system of statement 3, wherein spacing between the first hydrophone and the second hydrophone is 0.5 feet and 45 degrees apart.

Statement 5. The system of statement 4, wherein spacing between the first hydrophone and the lower-near monopole is 1 foot.

Statement 6. The system of statement 5, further comprising a far monopole, a dipole X, a dipole Y, and an upper far monopole.

Statement 7. The system of statement 6, wherein spacing between first hydrophone and the far monopole is 7.5 feet.

Statement 8. The system of statement 6, wherein spacing between first hydrophone and the dipole X is 9 feet.

Statement 9. The system of statement 6, wherein spacing between first hydrophone and the dipole Y is 10 feet.

Statement 10. The system of statement 6, wherein spacing between first hydrophone and the upper far monopole is 14 feet.

Statement 11. The system of statement 1, wherein the array of receivers comprises thirteen hydrophones.

Statement 12. The system of statement 11, wherein each receiver in the array of receivers is spaced 0.5 feet apart such that the array of receivers is 6 feet.

Statement 13. A method comprising: disposing a cement bond logging tool into a wellbore, wherein the cement bond logging tool comprises: two or more transmitters configured to transmit an acoustic wave from cement bond logging tool; and an array of receivers configured to receive a refracted waveform; and processing the refracted waveform from the array of receivers into a cement bond property log.

Statement 14. The method of statement 13, wherein the array of receivers comprises a first hydrophone and a second hydrophone.

Statement 15. The method of statement 14, wherein the two or more transmitters comprise an upper-near monopole and a lower-near monopole.

Statement 16. The method of statement 15, wherein spacing between the first hydrophone and the second hydrophone is 0.5 feet and 45 degrees apart.

Statement 17. The method of statement 16, wherein spacing between the first hydrophone and the lower-near monopole is 1 foot.

Statement 18. The method of statement 17, further comprising a far monopole, a dipole X, a dipole Y, and an upper far monopole.

Statement 19. The method of statement 18, wherein spacing between first hydrophone and the far monopole is 7.5 feet.

Statement 20. The method of statement 18, wherein spacing between first hydrophone and the dipole X is 9 feet.

The preceding description provides various embodiments of systems and methods of use which may contain different method steps and alternative combinations of components.

It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the elements that it introduces.

Therefore, the present examples are well adapted to attain the ends and advantages mentioned as well as those that are inherent therein. The particular examples disclosed above are illustrative only and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. A system comprising:

a cement bond logging tool comprising:

two or more transmitters configured to transmit an acoustic wave from cement bond logging tool; and an array of receivers configured to receive a refracted waveform; and an information handling system configured to process the refracted waveform from the array of receivers into a cement bond property log utilizing at least some spiral sampling comprising comparing a baseline receiver with its nearest receiver.

2. The system of claim 1, wherein the array of receivers comprises a first hydrophone and a second hydrophone.

3. The system of claim 2, wherein the two or more transmitters comprise an upper-near monopole and a lower-near monopole.

4. The system of claim 3, wherein spacing between the first hydrophone and the second hydrophone is 0.5 feet and 45 degrees apart.

5. The system of claim 4, wherein spacing between the first hydrophone and the lower-near monopole is 1 foot.

6. The system of claim 5, further comprising a far monopole, a dipole X, a dipole Y, and an upper far monopole.

7. The system of claim 6, wherein spacing between first hydrophone and the far monopole is 7.5 feet.

8. The system of claim 6, wherein spacing between first hydrophone and the dipole X is 9 feet.

9. The system of claim 6, wherein spacing between first hydrophone and the dipole Y is 10 feet.

10. The system of claim 6, wherein spacing between first hydrophone and the upper far monopole is 14 feet.

11. The system of claim 1, wherein the array of receivers comprises thirteen hydrophones.

12. The system of claim 11, wherein each receiver in the array of receivers is spaced 0.5 feet apart such that the array of receivers is 6 feet.

13. A method comprising:

disposing a cement bond logging tool into a wellbore, wherein the cement bond logging tool comprises:

two or more transmitters configured to transmit an acoustic wave from cement bond logging tool; and an array of receivers configured to receive a refracted waveform; and processing the refracted waveform from the array of receivers into a cement bond property log utilizing at least some spiral sampling comprising comparing a baseline receiver with its nearest receiver.

14. The method of claim 13, wherein the array of receivers comprises a first hydrophone and a second hydrophone.

15. The method of claim 14, wherein the two or more transmitters comprise an upper-near monopole and a lower-near monopole.

16. The method of claim 15, wherein spacing between the first hydrophone and the second hydrophone is 0.5 feet and 45 degrees apart.

17. The method of claim 16, wherein spacing between the first hydrophone and the lower-near monopole is 1 foot.

18. The method of claim 17, further comprising a far monopole, a dipole X, a dipole Y, and an upper far monopole.

19. The method of claim 18, wherein spacing between first hydrophone and the far monopole is 7.5 feet.

20. The method of claim 18, wherein spacing between first hydrophone and the dipole X is 9 feet.

* * * * *